United States Patent [19]

Rose et al.

[11] Patent Number: 4,656,918

[45] Date of Patent: Apr. 14, 1987

[54] ELECTROMAGNETIC INDUCTION METHOD AND APPARATUS THEREFOR FOR COLLAPSING AND PROPELLING A DEFORMABLE WORKPIECE

[75] Inventors: Millard F. Rose, King George, Va.; Osa E. Fitch, San Diego, Calif.

[73] Assignee: The United States of America as represented by the Secretary of the Navy, Arlington, Va.

[21] Appl. No.: 703,583

[22] Filed: Feb. 20, 1985

[51] Int. Cl.[4] ..... F41F 1/02; B21D 26/14

[52] U.S. Cl. ..... 89/8; 72/56; 124/3; 310/14

[58] Field of Search ..... 89/8; 124/3; 72/56; 102/476, 501; 42/76 R; 29/1.2; 310/12, 13, 14, 11

[56] References Cited

U.S. PATENT DOCUMENTS

| | | | |
|---|---|---|---|
| 3,206,652 | 9/1965 | Monroe | 124/3 X |
| 3,295,412 | 1/1967 | Morley et al. | 89/8 |
| 3,318,127 | 5/1967 | Astleford, Jr. | 72/56 |
| 3,372,566 | 3/1968 | Schenk et al. | 72/56 |
| 3,550,416 | 12/1970 | Schenk et al. | 72/56 |
| 3,929,119 | 12/1975 | Fletcher et al. | 89/8 X |
| 4,499,830 | 2/1985 | Majerus et al. | 102/476 |

OTHER PUBLICATIONS

Technical report, entitled "Single Stage Pulsed Induction Reaction Engine", by Peter Mongeau.

Article, entitled "Smart Munition System Developed for DARPA", as reported in the publication of Aviation Week and Space Technology, of Sep. 22, 1982.

*Primary Examiner*—Deborah L. Kyle

*Assistant Examiner*—John E. Griffiths

*Attorney, Agent, or Firm*—W. C. Townsend; T. E. McDonnell; E. E. Goshorn

[57] ABSTRACT

An improved electromagnetic induction method and apparatus therefor for simultaneously collapsing and propelling a deformable annular-shaped workpiece of relatively lightweight construction in a direction outwardly of the apparatus and along its axis wherein the apparatus is made up of seven different embodiments for carrying out the method. Each apparatus is generally comprised of a framework. The framework includes at least one pulse coil means; and a power supply circuit is connected to the pulse coil means. Annular-shaped surface portions of various embodiments of the apparatus define part of an aperture or passageway for receiving a workpiece and function to position the workpiece in mutual inductance relation to the coil means. The pulse coil means, when energized after positioning of a workpiece in an apparatus, causes the formation of a series of magnetic forces acting on the workpiece that causes progressive collapsing of the workpiece in a direction towards the axis of the apparatus so as to form a slug of solid-like construction and approximately cylindrical or spherical shape. At the same time, the positioned workpiece is accelerated and propelled at a relatively high velocity in a direction outwardly of the coil means and along the apparatus axis. The magnitude of the apex angle, as defined between surface or mandrel portions of an apparatus and the apparatus axis can be varied within limits and is relevant to the magnitudes of the magnetic force components that are generated by a coil means for collapsing, accelerating and propelling a workpiece.

14 Claims, 22 Drawing Figures

ELECTROMAGNETIC INDUCTION METHOD AND APPARATUS THEREFOR FOR COLLAPSING AND PROPELLING A DEFORMABLE WORKPIECE

BACKGROUND OF THE INVENTION

This invention concerns an electromagnetic induction method and apparatus therefor for simultaneously collapsing and propelling a workpiece; and, more particularly, it relates to an improved electromagnetic induction method and an improved apparatus for carrying out the method for progressively collapsing a relatively lightweight workpiece of annular shape and sheetlike construction toward an axis of the apparatus while at the same time accelerating and propelling the collapsed workpiece at a relatively high velocity in a direction outwardly of the apparatus and along the axis thereof.

In the past, various techniques have been developed for electromagnetically deforming a workpiece, propelling a workpiece or a combination thereof. For example, U.S. Pat. No. 3,295,412 to Morley et al. concerns a metallic particle accelerometer. The apparatus is generally made up of a magnetically responsive and deformable armature 14 and a cone-shaped solid explosive 30 operatively associated therewith. When the explosive is ignited, the armature is deformed to a conical shape. During ignition of the explosive a pulse coil is energized to accelerate and propel both the deformed armature and the particle carried thereby. U.S. Pat. No. 3,318,127 to Astleford, Jr. concerns an apparatus for magnetically forming a workpiece. The apparatus is generally made up of a pulse coil, a power supply control circuit; and a helically configured, field-shaping element. This shaping element assists in concentrating the magnetic flux uniformly about a workpiece to be formed. A technical report, that is entitled "Single Stage Pulsed Induction Reaction Engine" by Peter Mongeau under U.S. Army contract DAAK 10-79-C-0384 with the Francis Bitter National Magnet Laboratory of the Massachusetts Institute of Technology, relates to an apparatus for accelerating and propelling a ring-shaped workpiece without deforming the workpiece. The apparatus is generally comprised of a power supply circuit and a magnetic multi-ring flat-shaped pulse coil for accelerating and propelling the workpiece when the coil is energized. An article, that is entitled "Smart Munition System Developed for DARPA" as reported in the publication of "Aviation Week and Space Technology" of Sept. 22, 1982, discloses a dense metal disk. The disk, after being launched from a parent missile or rocket-type vehicle during flight of the vehicle, is explosively shaped into a slug-shaped configuration that has armor penetrating characteristics. None of the aforediscussed articles, report or references remotely suggest an improved electromagnetic induction apparatus and method for progressively collapsing an annular workpiece to form an approximately slug-shaped workpiece of solid, rigid construction while at the same time the progressively collapsed workpiece is accelerated and propelled at a relatively high velocity in a direction outwardly of the apparatus and along an axis thereof.

SUMMARY OF THE INVENTION

An object of this invention is to provide an electromagnetic induction apparatus for simultaneously collapsing and propelling a workpiece without the use of explosive materials.

Another object of this invention is to provide an electromagnetic induction apparatus for quickly centering and positioning a workpiece prior to the workpiece being progressively collapsed to a smaller size and at the same time the progressively collapsed workpiece also being accelerated so as to be propelled outwardly of the apparatus along an axis thereof.

Still another object of the invention is to provide an improved electromagnetic induction apparatus that can accelerate and propel a progressively collapsed slug-shaped workpiece of solid-like construction at a relatively high velocity.

Yet another object of the invention is to provide an improved electromagnetic induction apparatus that operates in an efficient manner while at the same time it is capable of recapturing unused energy after each operation.

Yet still another object of the invention is to provide an improved electromagnetic induction apparatus that includes mandrel surface portions and the like for guiding a deformable workpiece as it is being progressively collapsed, accelerated and propelled during apparatus use.

Yet still a further object of the invention is to provide an improved electromagnetic induction apparatus that, depending upon the rate at which a workpiece is to be initially and finally accelerated as well as progressively collapsed, the apparatus can be provided with one or more pulse coil means and workpiece engaging surface or mandrel portions with different apex angles in relation to the apparatus axis.

A summary of the invention is an improved electromagnetic induction method and apparatus therefor for progressively collapsing a deformable annular-shaped workpiece and simultaneously for accelerating and propelling the progressively collapsed workpiece at a relatively high velocity in a direction outwardly of the apparatus and along an axis thereof. The apparatus is generally made up of seven different embodiments with each apparatus being comprised of a framework. The framework includes at least one pulse coil means; and a power supply circuit arrangement is operatively connected to the coil means. The coil means in one apparatus embodiment is provided with an annular surface means that defines a concentric aperture. The surface means supportably engages a workpiece inserted in the aperture so as to enable the formation of mutual inductance between the workpiece and the coil means during apparatus use. The annular-shaped workpiece is of relatively lightweight, sheet metal construction and is made up of a suitable grade of electrically conductive coil material, e.g., a suitable grade of copper sheet material of frusto-conical shape. When the coil means is energized, an annular-shaped workpiece is normally fully collapsed into an approximately cylindrically-shaped slug of solid-like construction. Since the surface means usually has a frusto-conical shape in supportably engaging a workpiece, the surface means is projectable to intersect the apparatus axis so as to form a conical or apex angle therebetween. Depending on the magnitude of the magnetic force components required to cause progressive collapse of a workpiece and simultaneous acceleration and propulsion thereof, the conical angle can vary between forty-five and approximately eighty degrees (45° and 80°). The power supply circuit arrangement is generally made up of at least one capacitor means and switch means. The switch means not only enables selective charging of the capacitor means prior to apparatus use, but also selectively discharges the capacitor means when the coil means is being energized during apparatus use. When the apparatus provides a pair of capacitor means and appropriate switch means for selectively charging and discharging each capacitor means, the power requirements for simultaneously collapsing, accelerating, and propelling a workpiece may be minimized thereby enabling the invention to be used on more than one type of platform, e.g., ground, sea, air or space platform.

In a second embodiment of the apparatus, a framework section, pulse coil means, and workpiece are of hemispherical shape. Similarly, a third embodiment, a framework section, pulse coil means, and workpiece are of paraboloidal shape. By reason of the hemispherical and paraboloidal shapes of the coil means in the second and third embodiments, a hemispherical or paraboloidal workpiece is progressively collapsed to a slug of solid-like construction and approximately spherical shape.

In a fourth embodiment, the apparatus is provided with a framework having an internal concentrically arranged mandrel for supportably engaging and positively guiding a workpiece as it is being accelerated, propelled and progressively collapsed so as to positively maintain the workpiece in centered relation to the apparatus axis. Further, in a fifth embodiment the apparatus is made up of a pair of interconnected hollow framework sections of conical shape. Inner annular surface portions of one section center and support a conical shaped workpiece in relation to the pulse coil means prior to the workpiece being formed. The inner surface portions of the other section act as a mandrel in supportably engaging and positively guiding the workpiece as it is being accelerated, propelled, and progressively collapsed during apparatus use.

In a sixth embodiment of the apparatus, it is generally comprised of interconnected hollow framework sections. Inner and outer concentrically arranged mandrel portions are integrally connected to one of the sections. Each mandrel portion forms a different apex angle in relation to the apparatus axis. The interconnected sections between the opposed longitudinal ends of the apparatus include a common annular-shaped concentric passageway of generally conical-shaped configuration. One of the sections includes a pulse coil means at one end of the passageway and is concentrically disposed about the apparatus axis. A second pulse coil means is disposed about the outer periphery of the inner mandrel portion and is relatively spaced from the first pulse coil means. The mandrel portions define the inner periphery of the passageway. The workpiece, prior to being formed, is disposed adjacent the first pulse coil means at the closed or one end of the passageway. The annular interior surfaces of both sections together with the outer surfaces of the mandrel portions cooperate to guide and maintain the workpiece in concentric relation to the apparatus axis as the workpiece is being accelerated along the passageway during the progressive collapsing thereof. The workpiece after being formed is propelled from the apparatus along its axis at the open end of the passageway.

In a seventh embodiment, the apparatus is also generally comprised of interconnected hollow framework sections. The outer mandrel portion defines a greater apex angle with the apparatus axis than the outer mandrel portion of the sixth embodiment. Further, the apparatus includes first and second relatively spaced pulse coil means but the second pulse coil means is mounted in the outer framework section about the outer periphery of the passageway rather than being mounted about the outer surface of the inner mandrel portion as in the sixth embodiment.

Depending upon the manner in which a workpiece is to be collapsed and propelled, the apex angle between the apparatus axis and mandrel or surface portions of various embodiments is also variable within limits as with the first apparatus embodiment. Further, certain apparatus embodiments include barrel portions for guiding the workpiece as well as for inducing rotation of the workpiece for further stabilization of same as required.

Other objects, advantages and novel features of this invention will become apparent from the following detailed description of the invention when considered with the accompanying drawings, wherein:

DETAILED DESCRIPTION OF THE INVENTION

Figure 1:
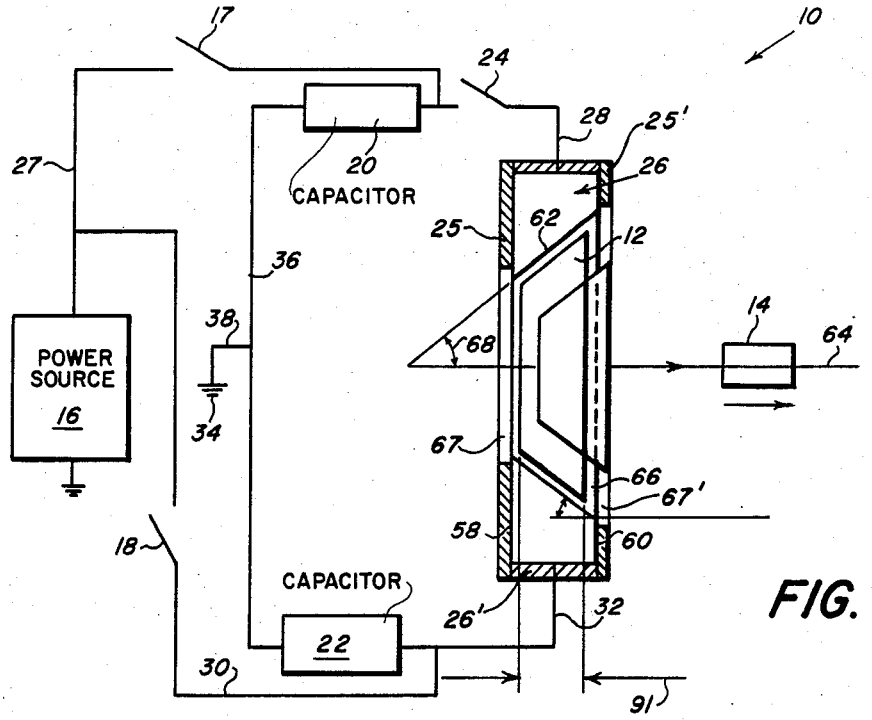
FIG. 1 is a diagrammatic view with certain parts in section that illustrates an embodiment of a method and apparatus of the invention for centering and supporting a frusto-conically shaped workpiece and for simultaneously collapsing, accelerating and propelling the workpiece.

With further reference to FIG. 1, an improved apparatus 10 is depicted for carrying out the improved method of centering and supporting a frusto-conically shaped deformable workpiece 12 of relatively light weight and sheet metal construction. The apparatus during operation functions to progressively collapse the workpiece and simultaneously accelerate and propel the workpiece so as to form a solid, slug-shaped workpiece 14 of approximately cylindrical-shaped configuration that is propelled along an axis of the apparatus toward a preselected point in a spatial field, The apparatus is generally comprised of a power source 16, first and second switches 17 and 18, a pair of capacitor subassemblies 20 and 22, an on/off switch 24, and a pulse coil component 26. The pulse coil component is supported by a framework of suitable dielectric material which is made up of a pair of opposed circular flat plates 25 and 25′ and an interconnecting sleeve 26′. The plates and sleeve are anchored to an appropriate support (not shown). Power source 16 is of any appropriate design, e.g., a portable power supply or a plug-in fixed power source that will meet the power requirements of a pulse coil in simultaneously collapsing and propelling a given workpiece of specified weight and design toward a preselected point in space, e.g., a target. As depicted in FIG. 1, first switch 17 is interposed between and connected via conduit 27 to power source 16 and capacitor 20. Second switch 18 is interposed between and connected via conduit 30 to power source conduit 27 and capacitor 22. Capacitors 20 and 22 are connected to a common ground 34 via conduits 36 and 38. Each of the capacitors 20 or 22 is of appropriate design and is usually made up of a series of parallel-interconnected oil-filled capacitors that are readily commercially available. Pulse coil 26 is interposed between and series connected to the pair of capacitors 20 and 22 by conduits 28 and 32.

Pulse coil 26 is preferably of annular shape and is provided with parallel-opposed end faces 58 and 60. Opposed faces 58 and 60 are interconnected by an interior annular surface 62 of frusto-conical or ring-like shape. The frusto-conical surface is disposed concentrically about axis 64 of coil 26 and defines the outer radial extent of a concentric frusto-conical aperture 66 therethrough. Plates 25 and 25′ are provided with concentric openings 67 and 67′ that present no restriction to aperture 66 or the acceleration and collapse of workpiece 12 inserted in the aperture during apparatus use. Frusto-conical surface 62 converges in a direction towards axis 64 to the left of coil face 58 as viewed in FIG. 1; and it is projectable to intersect axis 64 so as to define a conical angle 68 therebetween.

Workpiece 12 of frusto-conical shape is of relatively lightweight, sheet metal construction. The workpiece is composed of a suitable grade of electrically conductive material, e.g., a suitable grade of copper sheet material. The workpiece has a frusto-conical shape similar to surface 62 so that when the workpiece is inserted and positioned in aperture 66 from the outer larger end thereof, the workpiece is centered and supportably engaged by surface 62 between coil end faces 58 and 60. It is noted here that the thickness of the sheet material of the workpiece is always such that the workpiece is self-supporting without collapsing upon itself prior to energization of pulse coil 26 as will be more fully set forth hereinafter. If desired, coil 26 can be provided with an inwardly extending annular rib 70 (see FIG. 4) that is disposed immediately adjacent to face 60 for positively retaining a workpiece 12 that is inserted in aperture 66 and supportably engaged by surface 62. As will become more apparent hereinafter when the workpiece is supportably engaged by coil surface 62, mutual inductance occurs between coil 26 and workpiece 12 upon pulse energization of coil 26 during apparatus use.

Figure 2:
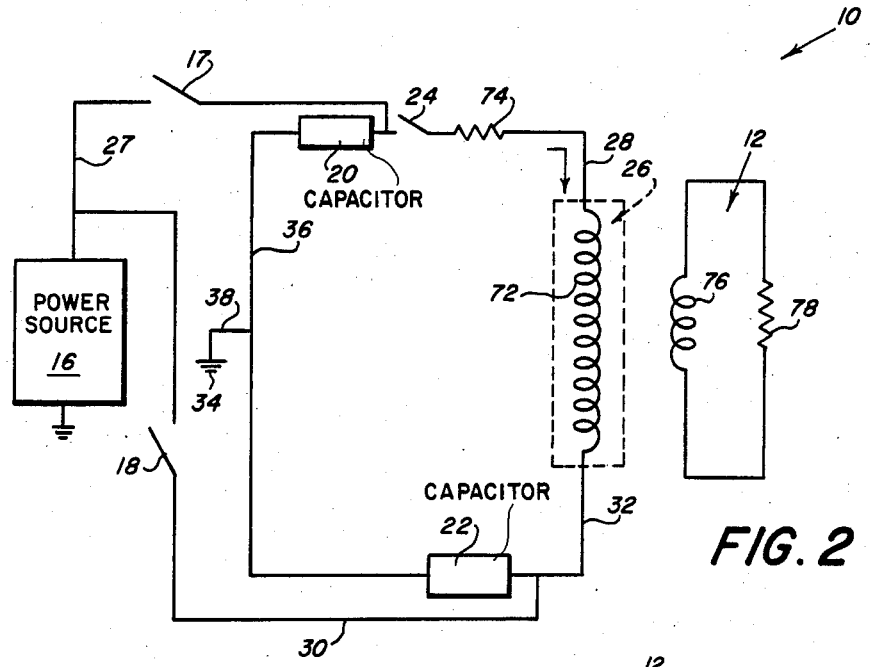
FIG. 2 is a schematic view of the apparatus of FIG. 1 with parts removed and other parts added, and illustrates further details of the invention.

Although not shown, pulse coil 26 is made up of a series of windings tightly wrapped about an annular core and then covered by an appropriate protective covering. As illustrated in FIG. 2, the coil is represented by a series of windings 72 along with a resistance 74 for the power circuit. Similarly, the workpiece is represented by a series of windings 76 of lesser number than coil windings 72 and a resistance 78. Depending on the frequency and the power of operation of pulse coil 26 during use of apparatus 10, it is to be understood that coil 26 can be provided with appropriate cooling means to prevent its overheating as the result of resistance 74. It is to be understood that the actual number of windings 72 for coil 26 and the number of windings 76 represented by workpiece 12 will of course depend upon the particular design of coil 26, the material and configuration of the workpiece, the requirements for simultaneously collapsing and accelerating a given workpiece, and the energy furnished by capacitors 20 and 22 during apparatus use. In other words, the number of windings for either coil 26 or workpiece 12 could be greater or less than shown in FIG. 2.

In an operative embodiment of apparatus 10, capacitor 20 will be charged when switch 17 is closed and switches 18 and 24 are open. The charged capacitor will discharge when switch 24 is closed and switches 17 and 18 are open so as to energize the windings of pulse coil 26. When coil 26 is energized, mutual inductance is formed between coil 26 and workpiece 12 which is supportably engaged by coil surface 62. By reason of the mutual inductance being formed, a magnetic flux is not only formed about windings 72 of coil 26, but a reactive current is induced in the workpiece, which is represented by windings 76 in FIG. 2, as well as a reactive magnetic flux thereabout. Moreover, by reason of the mutual inductance and energization of coil 26, the workpiece generates a magnetic force that counteracts and resists the greater magnetic force simultaneously generated by the coil windings. As the result of this resistance and counter action of the workpiece magnetic force and by reason of the workpiece lightweight sheet metal construction, the workpiece not only begins to accelerate out of its inserted position in the aperture in a direction toward coil end face 60 along axis 64, but it also is simultaneously progressively collapsed in a radial direction toward axis 64.

Figure 4:
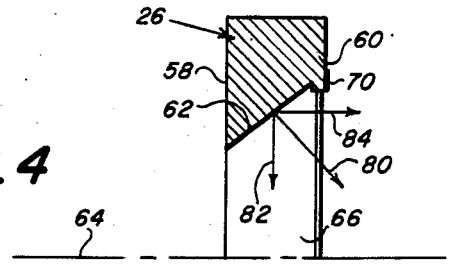
FIG. 4 is an enlarged partial cross-sectional view of the pulse coil component of the apparatus and illustrates further details of the invention.
Figure 5:
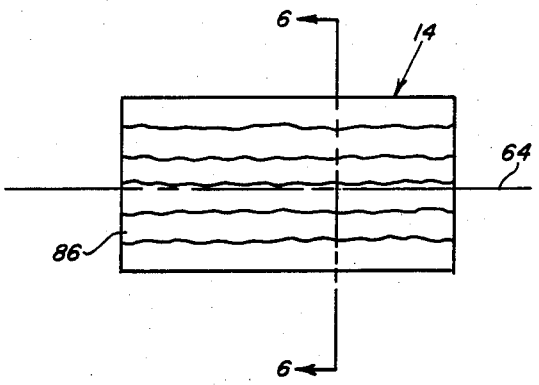
FIG. 5 is a diagrammatic elevational view of a solid, slugshaped workpiece produced by the invention.
Figure 6:
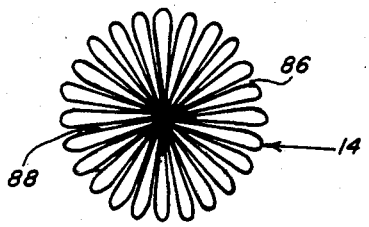
FIG. 6 is a cross-sectional view taken along line 6—6 of FIG. 5 and illustrates further details of the slug-shaped workpiece.

Because of the induced magnetic force of the workpiece together with the magnetic force of energized coil 26, an overall magnetic force acts on the workpiece and in a direction perpendicular to surface 62 at any point thereof about its entire periphery as generally indicated in FIG. 4. Radial component 82 of force 80 at each peripheral point of surface 62 acts to cause progressive and substantially uniform collapse of the workpiece into a solid, slug-shaped configuration. At the same time, axial component 84 of force 80 at each peripheral point of surface 62 acts on the workpiece to accelerate and propel the progressively collapsed and slug-shaped workpiece along axis 64 in a direction outwardly of coil end face 60. In other words, a series of magnetic forces 80 about the periphery of surface 62 act on a workpiece 12 to progressively collapse, accelerate and propel same in relation to apparatus 10 and coil 26 therein. By reason of force 80 at any point about surface 62, the workpiece is progressively collapsed to a smaller size and reduced dimensions by the sheet metal folding back upon itself first in one direction and then in the other until the workpiece is collapsed into a slug-shaped, solid configuration of approximately cylindrical shape as best shown in FIGS. 5–6. The series of various fold lines on the exterior of the workpiece are designated 86 and extend irregularly between the workpiece ends and in effect form flutes therebetween. Similarly, because opposed portions of the collapsed workpiece are folded back upon themselves first in one direction and then in the other, inner radial portions of the collapsed workpiece crowd together in an irregular manner to form internal fold lines 88 adjacent the collapsed workpiece longitudinal centerline as shown in FIG. 6.

Although component magnetic forces 82 and 84 are of the same magnitude since surface 42 and axis 64 form a conical angle of forty-five degrees (45°) therebetween, the conical angle can vary from about 45° (as shown in FIG. 4) to approximately eighty degrees (80° ). Variance of the conical angle is dependent on the energy rating of coil 26; size, weight, thickness, and actual material of workpiece 12; spatial point along axis 64 of apparatus to be reached by the collapsed and propelled workpiece; etc. In other words, the particular workpiece design together with the material used may require a collapsing force component 82 of lesser magnitude than the magnitude of accelerating force component 84 so as to assure efficient operation of apparatus 10 in progressively collapsing and accelerating a deformed and propelled workpiece from coil surface 62 to a preselected spatial point outwardly of coil 26 along its axis 64. Hence, the apparatus is highly versatile in that the conical angle of coil surface 62 can be readily changed within the aforementioned range to meet the requirements of more than one type of workpiece in collapsing and accelerating same for effecting propulsion of the collapsed workpiece to a desired point outwardly of apparatus 10 and along axis 64.

It is noted here that upon energization of coil 26 with a workpiece 12 supported by its surface 62, the magnetic force generated as the result of the mutual inductance between coil 26 and workpiece 12 will be substantially maintained until the accelerated and progressively collapsed workpiece is spaced from coil surface 62 at some predetermined point along the direction of force 80 toward coil axis 64. Even though the magnetic force rapidly diminishes as the workpiece advances away from coil 26, acceleration and progressive collapsing of the workpiece continues, due to inertia effects, until the longitudinal centerline of the finally accelerated and collapsed workpiece coincides with coil axis 64 for propulsion therealong. The actual spatial point reached by a propelled and collapsed workpiece will of course, for the most part, depend upon its final shape, weight, and drag characteristics.

In an operative embodiment of coil 26 for continuous and repetitive energization thereof, the pair of capacitors 20 and 22 and switch means 17, 18 and 24 are advantageously utilized. To this end, after charging capacitor 20 with switches 18 and 24 open and switch 17 closed, then, with switch 17 reopened, switch 24 is closed for energizing coil 26 and discharging capacitor 20. Capacitor 22 is partially charged from energy not used by coil 26 in accelerating and collapsing a workpiece 12. It is to be understood that switch 24 is timely opened by appropriate means (not shown) when capacitor 20 is sufficiently discharged thereby preventing accidental discharge of partially charged capacitor 22 before reuse of apparatus 10 with another workpiece 12 positioned in coil 26. Upon closing switch 18 with switches 17 and 24 open, partially charged capacitor 22 is fully charged by power source 16 prior to another operation of apparatus for discharging capacitor 22 upon closing switch 24 with switches 17 and 18 open. Hence, it is evident that switches 17–18 and 24 cooperate to permit repetitive operation of apparatus 10 for successively propelling collapsed workpieces while at the same time minimizing energy requirements of power source 16 as the result of either capacitor 20 or 22 recapturing unused energy of coil 26 during use of apparatus 10.

Figure 3:
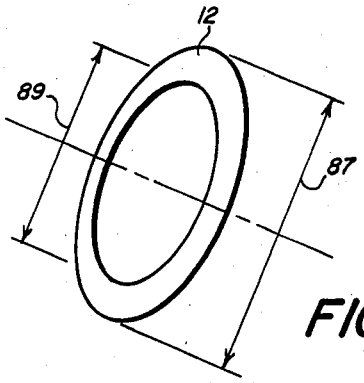
FIG. 3 is an enlarged perspective view of a frusto-conically shaped workpiece of sheet metal construction.

In one reduction to practice, workpiece 12 had an outside diameter of ten (10) inches, an inside diameter of six (6) inches, and an axial extent of three (3) inches, as indicated at 87 and 89 in FIG. 3 and as indicated at 91 in FIG. 1. The workpiece is composed of a suitable grade of copper sheet, weighed one hundred and eighty (180) grams, and had a thickness of thirty (30) mils. Power source 16 had a capability of up to twenty kilovolts (20 kv). Pulse coil inductance 72 was rated at thirty microhenries (30 uh). Further, each capacitor 20 or 22 had a capacitance of about 828 micro Farads. Upon operation of apparatus 10, the workpiece was collapsed into a solid-like slug of approximately cylindrical shape of about a two-inch outside diameter and accelerated up to a velocity of 300 meters per second (300 m/sec.). Further, the apparatus exhibited a forty percent (40%) efficiency by reason of energy recapture by either capacitor 20 or 22. Also the apparatus, between coil 72 and workpiece 12, exhibited an effective turns ratio on the order of twelve to one (12:1).

Figure 7:
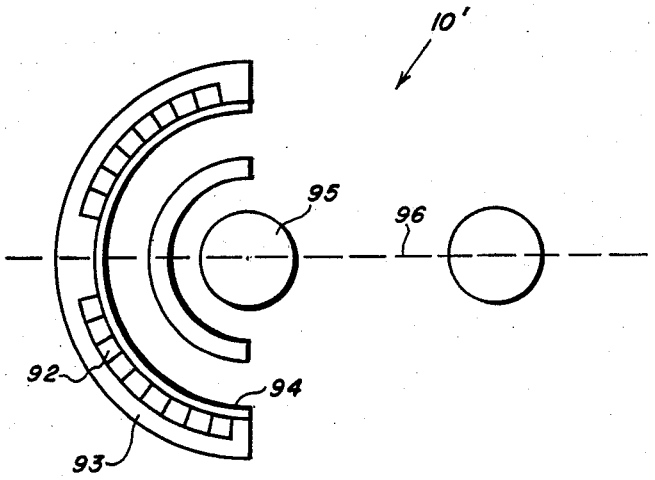
FIG. 7 is a cross-sectional view of a second embodiment of a pulse coil component and workpiece for use therewith and illustrates progressive collapsing and propulsion of the workpiece.

In a second embodiment of the invention, apparatus 10′ is comprised of a coil 92 having a hemispherical shape which is mounted in a framework 93 as illustrated in FIG. 7. Upon positioning a hemispherical workpiece 94 in the concentric aperture of the framework and then actuating apparatus 10′ in the manner aforedescribed for the embodiment of FIGS. 1–6, the workpiece will be progressively collapsed into a solid ball 95 of approximately spherical shape for propulsion along apparatus axis 96.

Figure 8:
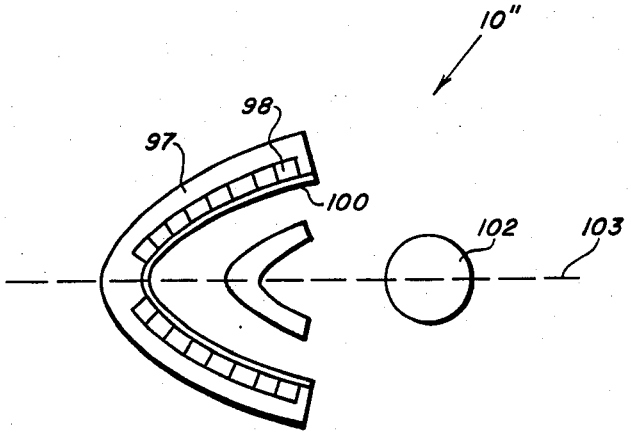
FIG. 8 is a cross-sectional view of a third embodiment of a pulse coil component and a workpiece for use therewith and illustrates progressive collapsing and propulsion of the workpiece.

In a third embodiment, apparatus 10″ as illustrated in FIG. 8 is generally comprised of a coil 98 that is shaped into a paraboloid and a framework 97 for supporting the coil. Upon positioning a paraboloidal workpiece 100 in the aperture of the framework and then energizing the coil, the workpiece will be accelerated and progressively collapsed into an approximately spherically-shaped slug 102 for propulsion along apparatus axis 103.

Figure 9:
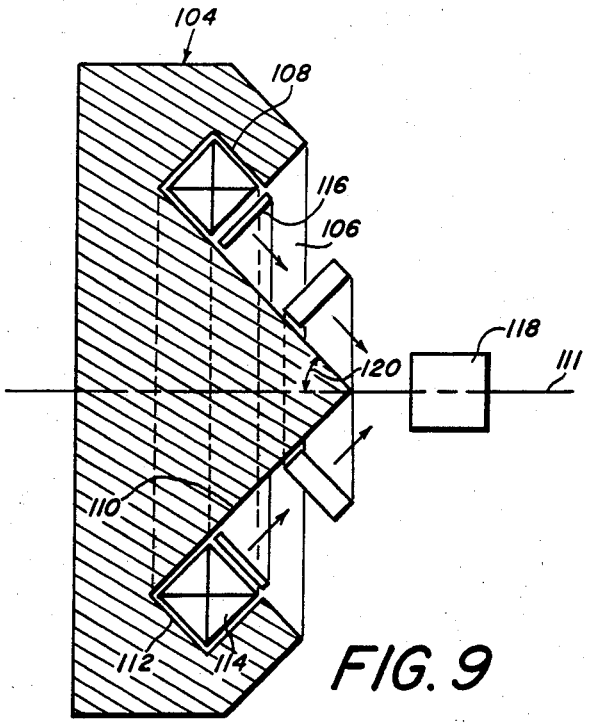
FIG. 9 is a cross-sectional view of a fourth embodiment of a pulse coil component of the invention and illustrates the workpiece being progressively formed by the coil means into an approximate cylindrical-shaped slug of solid-like construction.
Figure 11:
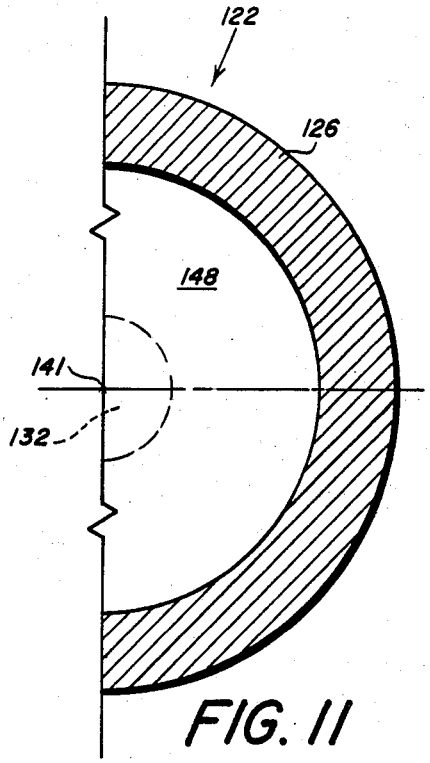
FIG. 11 is an enlarged sectional view taken along line 11—11 of FIG. 10.

A fourth embodiment of a pulse coil apparatus 104 is depicted in FIG. 9. The apparatus is generally made up of a framework of one piece cylinder-like construction. The right end face of the apparatus is partially cut away to define a conically-shaped aperture 106 as surrounded by outer annular surface 108 and inner conically-shaped mandrel 110. Surface 108 and mandrel 110 are concentrically disposed in relation to axis 111. The inner ends of surface 108 and mandrel 110 are interconnected by annular surface 112 that defines the inner end of aperture 106. An annular shaped electromagnetic coil 114 is mounted at the inner end of aperture 106 between surface 108 and mandrel 110. An annular shaped workpiece 116 of similar configuration to workpiece 12 of FIG. 3 is inserted in the aperture and disposed adjacent to the outer face of coil 114. 12 When coil 114 is energized, workpiece 116 is accelerated in a direction outwardly of coil 104, and progressively collapsed in a radial direction toward axis 111. At the same time, the workpiece is also positively guided by mandrel 110 as it propels to a spatial point outwardly of apparatus 104 along axis 111. When the workpiece accelerates from the outer end of mandrel 110, it has been transformed into an approximately cylindrically-shaped slug 118 of solid-like construction. Depending upon the force requirements of coil 114 for collapsing, accelerating and propelling a workpiece 116, the apex angle 120 between mandrel 110 and axis 111 can vary from that shown, e.g., the apex angle could have a range from forty-five (45) degrees to approximately ten (10) degrees. One reason for the aforementioned range of apex angle 120 in apparatus 10 is that this range assures that the axial force component generated by coil 114 upon energization thereof is always sufficient in magnitude for accelerating and propelling the workpiece along axis 111 as the workpiece is being progressively collapsed during apparatus use.

Figure 10:
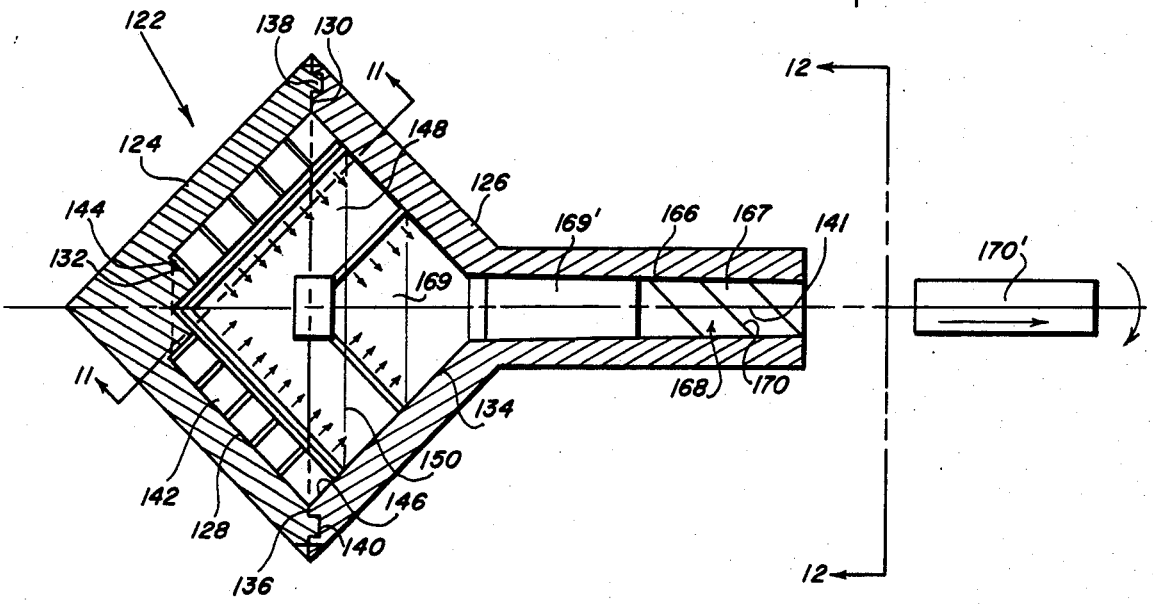
FIG. 10 is a cross-sectional view of a fifth embodiment of the pulse coil apparatus of the invention.

A fifth embodiment of a pulse coil apparatus 122, as illustrated in FIG. 10, is generally comprised of two interconnected hollow framework sections 124 and 126 of generally conical shape. Section 124 is provided with an inner concentrically arranged surface 128 of frustoconical shape that extends between an end face 130 of section 124 and an inner frusto conically-shaped boss 132 thereof. Section 126 is provided with an inner interior surface 134 of conical shape of similar shape as surface 128. The outer end of surface 134 has a radius corresponding to the radius at the outer end of surface 128. When end faces 130 and 136 of sections 124 and 126 are abutting, upon the sections being interconnected together, the outer ends of surfaces 128 and 134 intersect without overlapment about the entire periphery of the interconnected sections. In order to maintain the interconnected sections in concentric alignment during use of apparatus 122, end face 130 is provided with a concentric annular rib 138; and end face 136 is provided with a matching concentric annular groove 140 for receiving rib 138 as shown in FIG. 10. When sections 124 and 126 are connected and aligned they are concentrically disposed about common axis 141 of apparatus 122.

An electromagnetic coil 142 is affixed to surface 128 in an appropriate manner. The coil is made up of a series of five interconnected sections of annular shape and different size wherein the innermost section of the series has the smallest radius while the outermost section thereof has the largest radius. The coil is of such an extent that when it is affixed to surface 128 the inner face of innermost coil section abuts outer annular surface 144 of boss 132 while the outer annular surface 146 of outermost coil section abuts the outer end of surface 134 when sections 124 and 126 are connected together.

Prior to connecting sections 124 and 126 together, a conically shaped workpiece 148 is inserted in the hollow interior of section 124 such that the outer conically shaped surface of the inserted workpiece nests against the outer conically shaped surface of coil 142 while the apex end of the inserted workpiece is disposed in the conically shaped recess of boss 132. Conically shaped workpiece 148 is of such an extent that when sections 124 and 126 are interconnected, the outermost peripheral edge 150 of the inserted workpiece engages an outer peripheral portion of surface 134 as shown in FIG. 10.

Figure 12:
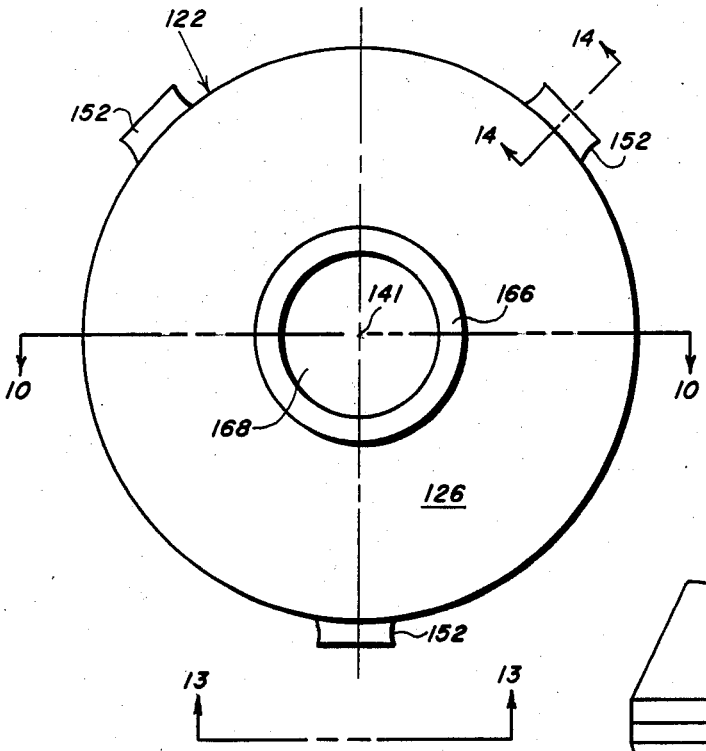
FIG. 12 is an enlarged elevational view taken along line 12—12 of FIG. 10 and with parts added.
Figure 13:
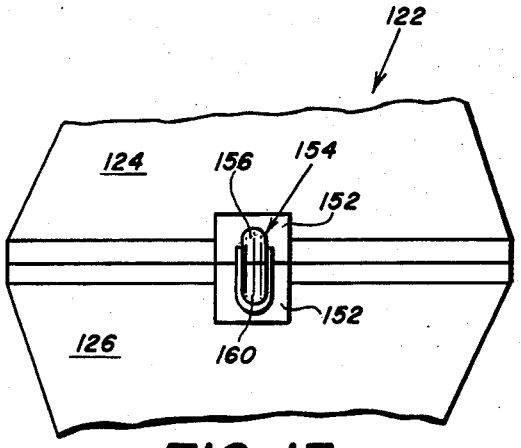
FIG. 13 is a fragmented plan view taken along line 13—13 of FIG. 12.
Figure 15:
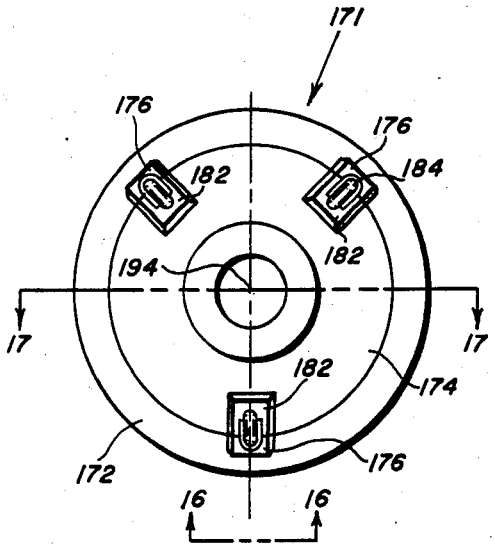
FIG. 15 is an elevational view of a sixth embodiment.

Interconnected sections 124 and 126 of apparatus 122 are appropriately secured together. To this end, the outer periphery of each section 124 and 126, is made up of a plurality of three bosses 152 circumferentially arranged equidistant from each other about the outer periphery of a section 124 or 126 as depicted in FIGS. 12 and 13. One end of each boss 152 of a section 124 or 126 is disposed in planar alignment to the associated end face 136 or 130 of section 124 or 126, respectively. A series of three releasable fastener devices 154 are provided; with each device 154 being mounted on opposed and axially aligned bosses 152 and 152 of interconnected sections 124 and 126 as best shown in FIG. 13.

Figure 14:
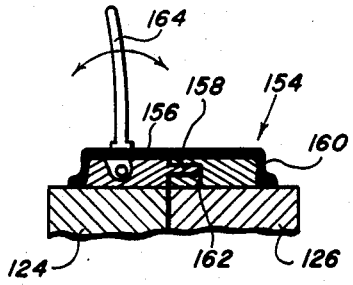
FIG. 14 is a cross-sectional view taken along line 14—14 of FIG. 12 and illustrates further details.

As best depicted in FIG. 14, each device 154 is generally comprised of opposed solid metal block elements 156 and 160. Elements 156 and 160 are suitably affixed to the top surfaces of axially aligned bosses 152 of interconnected sections 124 and 126 such that tongue 158 of element 156 is inserted in the recess 162 of element 160 of a given device 154 when sections 124 and 126 are interconnected. A U-shaped metal strap 164 is hingedly connected to upstanding element 156. When strap 164 is in its raised position, elements 156 and 160 of a device 154 can be freely connected as bosses 152 of sections 124 and 126 are aligned during connection of sections 124 and 126 respectively. Further, when elements 156 and 160 of all devices 154 are connected together during connection of sections 124 and 126, each strap 164 of all three devices 154 is lowered from its raised position to a lower position for encircling portions of its associated elements 156 and 160 of a respective device 154. With all three straps in their lowered positions, sections 124 and 126 are securely locked together and apparatus 122 is ready for use when a workpiece 148 is inserted therein as illustrated in FIG. 13. Although not shown, it is to be understood that the hinged connection of strap 164 to its associated element 156 is provided with a spring (not shown) for biasingly urging strap 164 to its lower position so that device 154 will stay in a locked condition during normal apparatus use. It is to be understood that the fastening devices 154 of apparatus 122 are designed to withstand the dynamic forces of the apparatus when used. Also that any suitable device can be used for fastening sections 124 and 126 together.

Depending on the guiding and centering requirements of apparatus 122, the vortex end of section 126 is provided with a barrel section 166 concentrically arranged about common axis 141 of the apparatus as shown in FIG. 10. An inner cylindrical surface 167 is progressively reduced in diameter between the ends of barrel section 166 so as to define a tapered opening 168 therebetween. Surface 167 between its ends is provided with a helical groove 170, the importance of which will become more fully apparent hereinafter. Barrel opening 168 is in direct open intercommunication with the common hollow interior of interconnected sections 124 and 126.

During use of apparatus 122, workpiece 148 is inserted between sections 124 and 126 and these sections then are aligned and locked together by the series of three devices 154 as aforedescribed. Upon actuation of coil 142 and by virtue of the mutual inductance between the coil and workpiece 148, the workpiece is accelerated in a direction outwardly of the apparatus along its axis 141 toward barrel opening 168 as the result of the axial force components of the magnetic forces generated by coil 142. At the same time, the accelerated and propelled workpiece as generally indicated at 169 in FIG. 10 is being progressively collapsed as the result of the radial force components of the magnetic forces generated by coil 142. Also, at the same time, since interior surface 134 of section 126 converges toward barrel opening 168, surface not only assists in progressively collapsing the workpiece by slidably engaging the outermost periphery of the propelled workpiece but also serves to positively guide the propelled workpiece as it continues to progressively collapse thereby positively maintaining the propelled and collapsed workpiece in aligned relation to apparatus axis 141. When the collapsed and propelled workpiece reaches the inlet end of barrel opening 168 it has been transformed from a conically-shaped workpiece 148 to an approximately cylindrically shaped slug 169' of solid-like construction. As slug 169' travels through the barrel opening it is further collapsed by virtue of tapered cylindrical surface 167. A helical groove 170 is provided in surface 167 between its ends as illustrated in FIG. 10. By virtue of the groove a spin is induced in slug so that a fully collapsed, propelled, and spinning slug 170' exits from apparatus 122. One advantage of spinning slug 170' is that it further stabilizes same for movement along axis 141.

Figure 16:
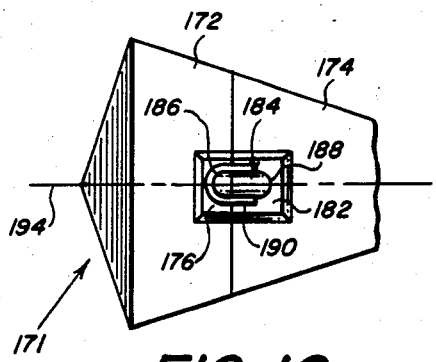
FIG. 16 is a fragmented plan view taken along line 16—16 of FIG. 15.

A sixth embodiment of a pulse coil apparatus 171 is depicted in FIGS. 15–18. The coil is generally made up of two interconnected framework sections 172 and 174 of frusto-conical shape. Section 172 is provided with a series of three equidistant raised bosses 176 about its periphery. An end face of each boss is disposed adjacent to and in planar alignment with annular end face 178 of section 172. Similarly, section 174 is provided on its outer periphery with a plurality of three raised bosses 182 that are disposed in equidistant relation to each other. An end face of each boss is disposed in planar alignment with end face 180 of section 174. As with coil 104 of FIGS. 10–14, a latching device 184 that is made up of components 186 and 188 is mounted on bosses 176 and 182. When the bosses are axially aligned, the series of three latching devices 184 about the outer periphery of coil apparatus firmly secure sections 172 and 174 together upon U-shaped arm 190 of each latching device being in its lowered position as depicted in FIG. 16.

End face 178 is provided with an annular rib 192 concentrically disposed about the common axis 194 of apparatus 171. End face 180 is provided with a matching annular recess 196. Hence, when sections 172 and 174 are connected together, rib 192 and groove 196 maintain the sections in concentric and axial alignment about axis 194 during use of apparatus 171.

Section 172 includes a mandrel 198 concentric about axis 194 having inner and outer mandrel portions 200 and 202 of frusto-conical and conical shape respectively. Outer conical surface 204 of mandrel portion 200 defines a different and larger apex angle with axis 194 than the outer conical surface 206 of mandrel portion 202, when outer surface 204 is projected to intersect axis 194. An interior frusto-conical surface 208 of section 172 extends axially inward from the inner periphery of end face 178. Surface 208 is spaced radially outward from outer surface 204 of mandrel portion 200 at its inner end and is concentrically disposed about axis 194. An interior frusto-conical surface 210 of section 174 extends from the inner periphery of end face 180 towards the narrow end of section 174. Surface 210 is also spaced radially outward from outer surface 204 of mandrel portion 200 and is concentrically arranged about axis 194. As evident from FIG. 17, surface 210, when sections 172 and 174 are connected together, constitutes a smooth extension of surface 208.

Another interior frusto-conical surface 212 of section 174 is spaced radially outward from outer surface 206 of outer mandrel portion 202 and concentrically arranged about axis 194. Surface 212 defines a smaller apex angle with axis 194 than surface 210 when surfaces 210 and 212 are projected to intersect axis 194. The outer and narrow end of section 174 includes a cylindrical-shaped opening 214 defined by the interior cylindrically shaped surface 216 at the outer end thereof.

By reason of three opposed series of relatively spaced and radially opposed surfaces 204 and 208; 204 and 210; and 206 and 212 these opposed series of surfaces define an overall conical shaped passageway 218 therebetween that extends longitudinally of apparatus 171 between the opposed inner enlarged ends of surfaces 204 and 208 and the outer narrow end of surface 212. As evident from FIG. 17, passageway 218 is in direct open communication with opening 214.

The opposed enlarged inner ends of surfaces 204 and 208 are interconnected by annular surface 220 at the inner end of passageway 218. Surface 220 is disposed at a right angle to either surface 204 or 208 about its entire periphery.

Figure 17:
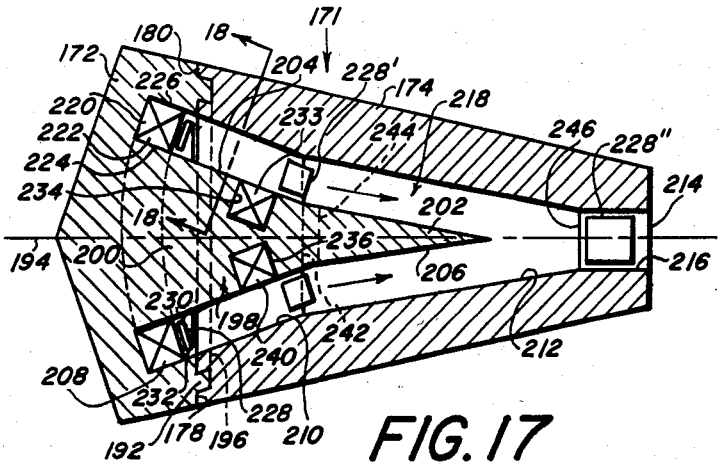
FIG. 17 is an enlarged cross-sectional view taken along line 17—17 of FIG. 15.
Figure 18:
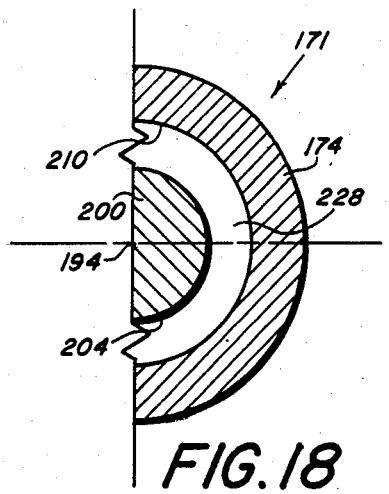
FIG. 18 is an enlarged cross-sectional view with parts removed as taken along line 18—18 of FIG. 17.

As depicted in FIG. 17, a pulse coil 222 of annular shape and of square-shaped configuration in transverse section about its entire periphery is inserted in the inner end of passageway 218 of section 172. The inner face of the inserted coil is seated about its entire periphery against surface 220. At the same time, inner and outer peripheral surfaces 224 and 226 of coil 222 slidably fit between surfaces 204 and 208. When coil 222 is seated against surface 220 it is positively retained thereagainst by suitable means not shown.

A frusto-conically shaped workpiece 228 of relatively thin construction and of rectangular shape in transverse section is inserted in passageway 218 at the outer end of section 172 when sections 172 and 174 are disconnected. The inner and outer peripheral surfaces 230 and 232 of the workpiece are radially dimensioned so as to slidably fit between opposed surfaces 204 and 208 of section 172. By reason of the workpiece slidably fitting between surfaces 204 and 208 the workpiece is supportably engaged by annular surface 204. At the same time, the workpiece is positioned against the outer annular face of coil 222 when sections 172 and 174 are interconnected prior to energization of coil 222 during normal use of apparatus 171.

Inner mandrel portion 198 adjacent its outer end is provided with an annular groove 233. The groove is defined by opposed annular end surfaces 234 and 236.

Each end surface 234 or 236 about its entire periphery is disposed at right angles to surface 204. The bottom of the groove is defined by an annular surface 238. Either end of surface 238 is disposed at right angles to its associated end surface 234 or 236. A second pulse coil 240 of annular shape and smaller radial extent than pulse coil 222 is inserted in groove 233. The outer annular surface of coil 240 about its entire periphery is an uninterrupted extension of surface 204 as shown in FIG. 17.

As is further evident from FIG. 17, it is evident that the annular junction line 242 between surfaces 210 and 212 of section 174 is longitudinally offset from the annular junction line 244 between inner and outer mandrel surfaces 204 and 206. It is to be understood that by reason of the radial spacing between surfaces 204 and 210 and between surfaces 206 and 212 together with the axial spacing between junction lines 242 and 244 is such that a workpiece 228' as it is being progressively collapsed and accelerated along passageway 218 will not bend or otherwise jam between surfaces 204 and 210 or between surfaces 206 and 212 during normal use of apparatus 171 as indicated in FIG. 17. Similarly, annular junction line 246 between surfaces 212 and 216 at the inner end of opening 214 will not result in the binding of a finally shaped workpiece 228" as it propels from the exit opening of apparatus 171 during its use.

Figure 19:
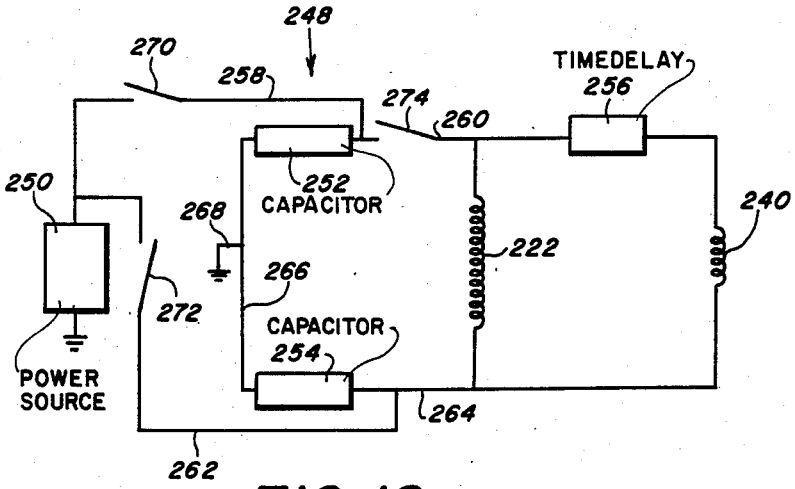
FIG. 19 is a schematic view of an electric circuit for use with the sixth and seventh apparatus embodiments of the invention.
Figure 22:
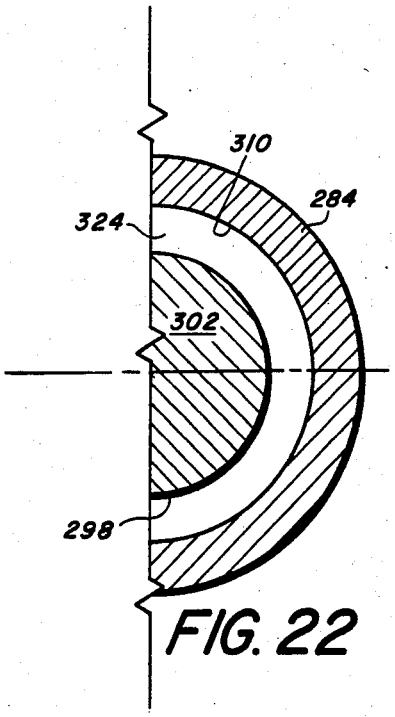
FIG. 22 is an enlarged cross-sectional view with parts removed as taken along line 22—22 of FIG. 20.

With reference to FIG. 19, a power supply circuit 248 is provided for timely and sequentially energizing both coils 222 and 240 in operating apparatus 171. The circuit is generally made up of a power source 250, a pair of capacitors 252 and 254 and a time delay device 256. The power source is connected to capacitor 252 by way of conduits 258 and 260; and to capacitor 254 by way of conduits 258, 262 and 264. A conduit 266 which is connected to both capacitors 252 and 254 is also connected to a common ground 268. Coil 222 is connected across conduits 260 and 264. Conduit 260 is connected to time delay device 256. Coil 240 is connected to device 256 and conduit 264. Normally open switches 270 and 272 are provided in conduits 258 and 262 for selectively charging capacitors 252 and 254 by source 250. Normally open on/off switch 274 is connected to conduit 260 between coil 222 and capacitor 252.

Assuming that capacitor 252 has been charged by closing switch 270, circuit switch 274 after reopening switch 270 is now closed thereby energizing coil 222. Energization of coil 222 causes initial acceleration of workpiece 228 from its starting position against coil 222 as shown in FIG. 17. Since the longitudinal axis of coil 222 is at an angle to the axis 194 of apparatus 170, the force generated by the energized coil includes horizontal and radial force components about its entire periphery. The radial components together with the convergence of passageway between surfaces 204 and 208 and between surfaces 204 and 210 progressively collapse the workpiece from its larger flat annular profile to a small annular thicker profile 228' of approximately initial cylindrical shape. At the same time, the progressively collapsed workpiece is being accelerated and propelled by the horizontal force component of energized coil 222 in passageway 218 toward junction line 242.

Device 256 of control circuit 248 as the workpiece approaches second coil 240 timely energizes the second coil so that the workpiece is further accelerated to a higher velocity or rate of propulsion and finally progressively collapsed to its desired compressed shape of a solid-like cylindrically shaped plug 228" as it exits from apparatus 171. Since second coil 240 is disposed about inner mandrel portion 200 and with its longitudinal axis at a different angle to apparatus axis 194 than coil 222, the energized second coil generates an outwardly directed radial force component about its periphery that is a reverse direction to the inwardly directed radial force component of previously energized coil 222. However, despite the reverse direction of the radial force component of second energized coil 240, opposed surfaces 206 and 212 of converging passageway 218 assist in guiding and progressively collapsing workpiece 228' to its final shape 228" as it is further accelerated and propelled by the horizontal force component of second energized coil 240 in a direction toward the exit of apparatus 171. Since coil 222 is disposed at the inner end of passageway 218 while coil 240 is disposed in a groove 233 that is arranged perpendicular to the passageway, it is evident that energized coil 222 would usually generate a greater horizontal force component for accelerating the workpiece than second coil 240. Thus, by the use of two or more relatively spaced coils, the rate for both accelerating and collapsing a workpiece can be divided into more than one stage while at the same time the magnitude of either the workpiece acceleration rate or progressive collapsing rate can be tailored to a great extent so as to meet, in an efficient manner, the particular forming and accelerating characteristics of a given workpiece material. One of the advantages of opening 214 is that it has a final positive centering and guiding effect on the workpiece as it propels along axis 194 prior to the workpiece exiting from the apparatus 171 to a preselected point in a spatial field outwardly thereof.

Figure 20:
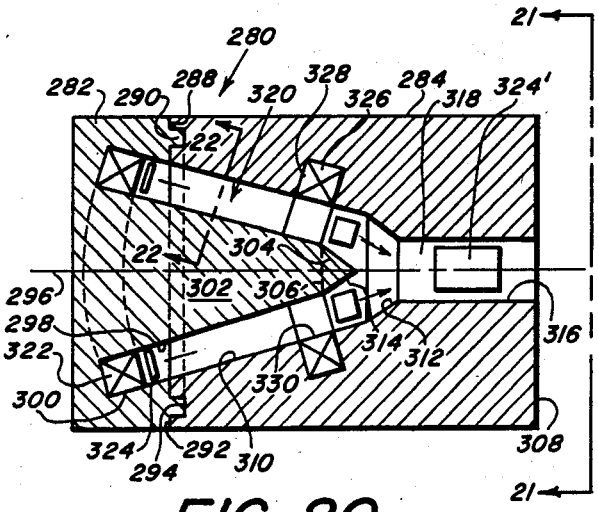
FIG. 20 is a longitudinal sectional view of a seventh embodiment as taken along line 20—20 of FIG. 21.
Figure 21:
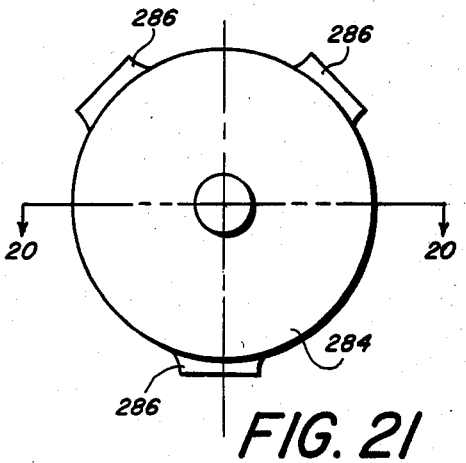
FIG. 21 is an elevational view taken along line 21—21 of FIG. 20.

In a seventh embodiment, a coil apparatus 280 is generally made up of two interconnected framework sections 282 and 284 of generally cylindrical shape as shown in FIG. 20. The outer surface of each section 282 or 284 is provided with a series of three radially and axially alignable correspondingly shaped bosses 286 as illustrated for section 284 in FIG. 21. Each pair of radially and axially aligned bosses, namely boss 286 of section 284 and boss (not shown) of section 282 are adapted to receive a latch mechanism, such as, e.g., as aforediscussed in FIGS. 10–14, for positively securing interconnected sections 282 and 284 together. End face 288 of section 282 is provided with a concentric annular rib 290. End face 292 of section 284 is provided with a concentric matching annular groove 294 for slidably receiving rib 290 when the sections are interconnected. Hence, the cooperative action between rib 290 and groove 294 assures that interconnected sections 282 and 284 are concentrically and axially aligned about axis 296 of apparatus 280 during its normal use.

The interior of section 282 at its end face 288 extends in an outwardly diverging direction toward the outer end of section 282 so as to define inner and outer relatively spaced frusto-conical surfaces 298 and 300 concentrically disposed about axis 296. Inner frusto-conical surface 298 longitudinally extends in a direction from adjacent end face 288 toward the interior of section 282. Surface 298 also extends in the opposite direction in a converging manner so as to form an inner mandrel portion 302 as shown in FIG. 20. An outer mandrel portion 304 of conical shape and smaller longitudinal extent than inner mandrel portion 302 is connected to the outer end of inner mandrel portion at the common planar junction 306.

The interior of section 284 at end face 292 is provided with a frusto-conical interior surface 310 concentrically disposed about axis 296 that extends from end face 292 and converges in a direction toward end face 308. The outer end of surface 310 adjacent end face 292 has a radius corresponding to the radius of surface 300 of section 282 adjacent its end face 288. By reason of the radius correspondency between surfaces 300 and 310 at end faces 288 and 292, surface 310 about its entire periphery provides a smooth uninterrupted extension of surface 300 when sections 282 and 284 are interconnected.

The interior of section 284 is also provided with a frusto-conical surface 312 that is an extension to the narrow end of surface 310 and that is concentrically disposed about axis 296. Surface 312 is spaced radially outward from outer conical surface 314 of the outer mandrel portion 304 and is parallel spaced therefrom. As evident from FIG. 20, surface 312 has a longitudinal extent substantially corresponding to the extent of outer mandrel portion 304. Further, relatively spaced and opposed surfaces 314 and 312 define a greater apex angle with axis 296 than relatively spaced and opposed surfaces 298 and 300; and 298 and 310 when they are projected to intersect axis 296.

Section 284 is also provided with a cylindrically shaped interior surface 316 between the narrow end of conical surface 312 and end face 308 that defines a concentric exit opening 318. As is further evident from FIG. 20, opposed surfaces 298 and 300, 298 and 310, and 314 and 312 of interconnected sections 282 and 284 define an overall conically shaped passageway 320 in direct open communication with opening 318.

An annular-shaped pulse coil 322 is inserted in the inner end of passageway 320 within section 282 in similar fashion as in the embodiment of FIGS. 15–18. An annular workpiece 324 of relatively thin construction and doughnut-like profile is inserted in the inner end of passageway 320 and disposed against the exposed or outer face of coil 322.

An annular groove 326 is provided in interior surface 310 of section 284 at an area generally spaced radially outward from junction plane 306 between mandrel portions 302 and 304. A second coil 328 of annular shape of somewhat smaller radial extent than first coil 322 is disposed in groove 326 such that interior annular surface 330 of coil 328 is concentrically disposed about axis 296 and is a smooth uninterrupted extension of surface 310 between its ends.

In view of the aforegoing description of FIG. 19 for the operation of the embodiment of FIGS. 15–18, it is obvious that coils 322 and 328 are operable in a similar and timely sequential manner for accelerating and progressively collapsing a workpiece 324 from its starting position against the outer annular face of coil 322 until it is fully progressively collapsed and propelled as a slug of solid-shaped construction 324' with minimal drag as it exits from apparatus 280 along axis 296.

As is evident in comparing the apparatus of FIG. 17 with the apparatus of FIG. 20, second pulse coil 328 is mounted in the interior of section 284 rather than the inner mandrel portion as in FIG. 17. By disposing the second coil in section 284, the radial force components which are generated by both coils 322 and 328 when energized are each directed radially inward. Further, since outer surface 314 of outer mandrel portion 304 of apparatus 280 has a greater apex angle with axis 296 than outer surface portion 206 of outer mandrel 202 of apparatus 171 has with axis 194, outer mandrel portion 304 is of relatively shorter length than outer mandrel portion 202. Hence, by controlling the apex angle of outer mandrel portion of apparatus 171 or 280 and by selectively positioning second coil 240 or 328, an apparatus 171 or 280 can be tailored to give desired results on a workpiece for substantially forming and propelling the workpiece.

Although not shown for apparatus 10', 10'', 104, 122, 171, or 280, it is to be understood that any appropriate support can be provided for firmly anchoring the framework of a given apparatus of the invention prior to use. Further, as with the apex angle of apparatus 104 of FIG. 9, the apex angle of surfaces 128 and 130 of sections 124 and 126 of apparatus 122 can be varied within limits and depending on the accelerating and collapsing force requirements for propelling and collapsing a workpiece. Similarly, the apex angles of mandrel surfaces 204 and 206 of apparatus 171 and mandrel surfaces 298 and 314 of apparatus 280 can be varied within limits. Although not heretofore mentioned, the framework of apparatus 10', 10'' and 104; framework sections 124 and 126, 172 and 174, and 282 and 284 of apparatus 122, 171 and 280 respectively, all incorporate in some fashion suitable dielectric material (not shown) so as to assure efficient operation of pulse coil means 108, 142, 222 and 240, and 322 and 328 in connection with the acceleration and collapsing of a workpiece. Since barrel 166 of apparatus 122 functions to collapse, guide and spin a workpiece, the barrel is composed of a hard wear-resistant material, e.g., a suitable grade of steel.

Obviously, many modifications and variations of the present invention are possible in light of the above teachings. It is therefore to be understood that, within the scope of the appended claims, the invention may be practiced otherwise than as specifically described.

What is claimed as new and desired to be secured by letters patent of the United States is:

1. An electromagnetic induction method for progressively collapsing an annular shaped deformable workpiece about its axis while at the same time simultaneously accelerating the progressively collapsed workpiece for propulsion therealong comprising the steps of:

initially positioning and supporting a frusto-conical shaped deformable workpiece in concentric relation about an axis, the workpiece being of a suitable grade of electric conductive material and of relatively lightweight sheet-like construction, and generating a series of electromagnetic forces in pulse-like fashion and sufficient duration about the periphery of the workpiece, such that each force of the series of forces is directed toward the axis but in angular relation thereto, the radial force component of each one of the forces of the series thereof acting on the workpiece so as to progressively collapse the workpiece about its periphery in a radial direction from its initial position and support towards the axis in order to effect formation of the workpiece into an approximately cylindrically-shaped slug of reduced dimensions and solid-like construction while at the same time the axial force component of each one of the forces of the series thereof acting on the workpiece in a direction outwardly of its initial position and support and along the axis in order to cause acceleration and propulsion of the workpiece from its initial position and support to another position along the axis that is spaced outwardly of its initial position and support as the workpiece is also progressively collapsed to a slug of cylindrical shape and solid-like construction.

2. A method as set forth in claim 1 wherein the combined step of initially positioning and supporting a workpiece is effected by pulse coil means.

3. A method as set forth in claim 2 wherein the pulse coil means is energized by power supply circuit means having capacitance means and selectively operable switch means.

4. A method as set forth in claim 1 wherein the combined step of initially positioning and supporting a workpiece is effected by pulse coil means having surface means of frusto-conical shape for supporting and engaging the workpiece so as to form mutual inductance between the workpiece and the pulse coil means during deformation and acceleration of the workpiece.

5. An electromagnetic induction apparatus for simultaneously collapsing and propelling a frusto-conical shaped deformable workpiece of a suitable electrically conductive material, and of relatively lightweight sheet-like construction, said apparatus comprising:

framework means, said framework meeans having pulse coil means that includes aperture means, the aperture means being concentrically arranged about the apparatus axis, said coil means being provided with frusto-conically shaped surface means concentrically arranged about the axis; the frusto-conically-shaped surface means surrounding the aperture means and supportably engaging a workpiece when inserted in the aperture means so as to enable the formation of mutual inductance between the workpiece and the coil means during apparatus use, power supply means, capacitor means interposed between and connected to said power supply means and said pulse coil means, first switch means interposed between and connected to said capacitor means and said power supply means for selectively connecting said power supply means to said capacitor means so as to effect charging of the capacitor means during use of said apparatus, and on-off switch means interposed between and connected to said capacitor means and said coil means for selectively connecting said capacitor means to said coil means after charging of said capacitor means and disconnection of said first switch means, said capacitor means for energizing said pulse coil means upon discharge of said capacitor means during connection of said on/off switch means so as to cause formation of a series of magnetic forces about the periphery of the frusto-concially shaped surface means such that each one of the forces of the series thereof acts in a direction toward the apparatus axis but in angular relation thereto, said pulse coil means upon energizing same having a radial force component for each one of the forces of the series thereof acting on the workpiece so as to progressively collapse the workpiece asbout its periphery in a radial direction from the surface means towards the apparatus axis in order to effect formation of the workpiece into an approximately cylindrically shaped slug of smaller size and solid-like construction while at the same time said pulse coil means upon energizing same having an axial force component for each one of the forces of the series thereof acting on the workpiece in a direction outwardly of the apparatus so as to accelerate and propel the workpiece from the surface means to a spatial point in a direction outwardly of the apparatus along its axis as the workpiece is progressively collapsed to a smaller-sized slug of cylindrical-shape and solid-like construction.

6. An apparatus as set forth in claim 5 wherein said coil means is of cylindrical shape having opposed end faces, and with the aperture means extending between the end faces.

7. An apparatus as set forth in claim 5 wherein said surface means has means for retaining the workpiece therein and wherein the retaining means is a lug-type configuration.

8. An apparatus as set forth in claim 5 wherein the frusto-conical shaped surface means substantially corresponds to the frusto-conical shape of the workpiece.

9. An apparatus as set forth in claim 5 wherein said surface means and the apparatus axis define an angle therebetween of about forty-five degrees (45°).

10. An apparatus as set forth in claim 9 wherein the conical angle is within a range from about forty-five degrees (45°) to approximately eighty degrees (80°).

11. An electromagnetic induction apparatus for simultaneously collapsing and propelling a frusto-conical shaped deformable workpiece of a suitable electrically conductive material, and of relatively lightweight sheet-like construction, said apparatus comprising:

framework means, said framework means having pulse coil means that includes aperture means, the aperture means being concentrically arranged about the apparatus axis, said coil means provided with frusto-conically shaped surface means concentrically arranged about the axis; the fursto-conically-shaped surface means surrounding the aperture means and supportably engaging a workpiece when it is inserted in the aperture means so as to enable the formation of mutual inductance between the workpiece and the coil means during apparatus use, power supply means, first and second capacitor means, first switch means interposed between and connected to said first capacitor means and said power supply means for selectively charging the first capacitor means during apparatus use, second switch means interposed between and connected to said power supply means and said second capacitor means for selectively charging said second capacitor means during apparatus use, said pulse coil means being interposed between and electrically interconnected to said first and second capacitor means, and third switch means interposed between and connected to said first capacitor means and said pulse coil means; said third switch means for selectively interconnecting said coil means to said first and second capacitor means and for causing energization of said coil means upon discharging one of said capacitor means of said first and second capacitor means while at the same time partially recharging the other one of said capacitor means thereof when said first and second switch means are disconnected, and said third switch means is connected;

one of said capacitor means of said first and second capacitor means for energizing said coil means upon discharge of the one capacitor means during connection of said third switch means so as to cause formation of a series of magnetic forces about the periphery of the frusto-conically shaped surface means such that each one of the forces of the series thereof acts in a direction toward the apparatus axis but in angular relation thereto, said pulse coil means upon energizing same having a radial force component for each one of the forces of the series thereof acting on the workpiece so as to progressively collapse the workpiece about its periphery in a radial direction from the surface means towards the apparatus axis in order to effect formation of the workpiece into an approximately cylindrically shaped slug of smaller size and solid-like construction while at the same time said pulse coil means upon energizing same having an axial force component for each one of the forces of the series thereof acting on the workpiece in a direction outwardly of the apparatus so as to accelerate and propel the workpiece from the surface means to a spatial point in a direction outwardly of the apparatus along its axis as the workpiece is being progressively collapsed to a smaller-sized slug of cylindrical shape and solid-like construction.

12. An apparatus as set forth in claim 11 wherein the conical angle is within a range from about forty-five degrees (45°) to approximately eighty degrees (80°).

13. An apparatus as set forth in claim 11 wherein said surface means has means for retaining the workpiece therein and wherein said retaining means is of lug-type configuration.

14. An apparaptus as set forth in claim 11 wherein the frusto-conically shaped surface means substantially corresponds to the frusto-conical shape of the workpiece.

* * * * *